US007578014B1

(12) United States Patent
Rodriguez

(10) Patent No.: US 7,578,014 B1
(45) Date of Patent: Aug. 25, 2009

(54) PILLOW APPARATUS AND METHOD

(76) Inventor: Natalia E. Rodriguez, 305 E. 84th St., New York, NY (US) 10028

( * ) Notice: Subject to any disclaimer, the term of this patent is extended or adjusted under 35 U.S.C. 154(b) by 0 days.

(21) Appl. No.: 12/112,014

(22) Filed: Apr. 30, 2008

(51) Int. Cl.
*A47G 9/10* (2006.01)

(52) U.S. Cl. ..... 5/636; 5/639; 5/640; 5/490

(58) Field of Classification Search ..... 5/490, 5/636, 639, 640, 645, 657
See application file for complete search history.

(56) References Cited

U.S. PATENT DOCUMENTS

| | | | | | |
|---|---|---|---|---|---|
| 4,309,784 | A * | 1/1982 | Cohen | ..... | 5/639 |
| 4,815,154 | A * | 3/1989 | Grimes | ..... | 5/657 |
| 4,991,245 | A * | 2/1991 | Franco | ..... | 5/419 |
| 5,168,590 | A * | 12/1992 | O'Sullivan | ..... | 5/490 |
| 5,271,114 | A | 12/1993 | Kjersem | ..... | 5/640 |
| 5,367,731 | A * | 11/1994 | O'Sullivan | ..... | 5/645 |
| 5,987,667 | A | 11/1999 | Haverly et al. | ..... | 5/485 |
| 6,895,619 | B1 | 5/2005 | Lee | ..... | 5/636 |
| 6,957,462 | B1 | 10/2005 | Wilcox | ..... | 5/636 |
| 7,089,617 | B1 | 8/2006 | Lauro | ..... | 5/636 |
| 2005/0177941 | A1 | 8/2005 | Miller | ..... | 5/490 |
| 2007/0220679 | A1 | 9/2007 | Dockendorf et al. | ..... | 5/655 |
| 2009/0013466 | A1 * | 1/2009 | Yates et al. | ..... | 5/490 |

* cited by examiner

*Primary Examiner*—Robert G Santos
(74) *Attorney, Agent, or Firm*—Walter J. Tencza, Jr.

(57) ABSTRACT

An apparatus is disclosed including a pillow case having a top and a bottom, the top opposite from the bottom. The pillow case may include a first pocket attached to the top, and a second pocket attached to the bottom. The pillow case may have a main inner chamber located within the pillow case, such that a pillow cushion can be located within the pillow case. The first pocket may run substantially along an entire width of the pillow case, and the second pocket may run substantially along an entire length of the pillow case. The pillow case and cushion can be inserted into the first or second pockets. A variety of pillow configurations can be created from this apparatus.

10 Claims, 14 Drawing Sheets

PILLOW APPARATUS AND METHOD

FIELD OF THE INVENTION

This invention relates to improved methods and apparatus concerning pillows.

BACKGROUND OF THE INVENTION

There are various devices known in the prior art for providing pillows. Most of these devices have one form and/or shape. They typically have one width, one thickness, and one level of firmness. U.S. Pat. No. 6,957,462 discloses a travel pillow that can only be used in one position. It is for the neck. It has a strap which is thick and extends across the body to hold in place. This can be uncomfortable and can restrict circulation. U.S. Pat. No. 7,089,617 discloses a pillow which has two small exterior pockets 58 and 62, which are on the same side of the pillow or pillow case. These pockets do not extend the length of the pillow and are for the purpose of hiding jewelry or other valuables. U.S. Pat. No. 6,895,619 discloses a large sheet of material which is folded or rolled to configure a custom bed pillow. U.S. Pat. No. 5,987,667 discloses a blanket which can be folded into a pillow configuration. The blanket has first and second pocket panels 8 and 14, both of which are centrally located and do not run the length of the blanket. Pocket panel 8 is located on the top surface 2 and pocket 14 is located on the bottom surface 14. The blanket is not a pillow case and does not have a main inner chamber into which a pillow cushion can be inserted.

U.S. Pat. No. 5,271,114 discloses folding a pillow to provide a pocket 3. However, it does not provide a first pocket on a top and a second pocket on a bottom. U.S. patent application no. 2005/0177941 A1 describes a case for enclosing a pillow case with pockets 2 and 3. However, the pockets are located on the same surface and/or side of the pillow case. U.S. patent application no. 2007/0220679 A1 discloses a pregnancy pillow that converts into an infant play station once the mother no longer has a use for the pillow.

The prior art does not address the need for multiple pillow forms satisfactorily.

SUMMARY OF THE INVENTION

One or more embodiments of the present invention disclose a pillow that can be converted into other pillow forms. In one embodiment, an apparatus is disclosed comprising a pillow case having a top and a bottom, the top opposite from the bottom. The pillow case may include a first pocket attached to the top, and a second pocket attached to the bottom. The pillow case may have a main inner chamber located within the pillow case, such that a pillow cushion can be located within the pillow case.

The pillow case may have a width and a length. The first pocket may run substantially along the entire width of the pillow case, and the second pocket may run substantially along the entire length of the pillow case. The first pocket may be substantially perpendicular to the second pocket. The pillow cushion may be located inside of the pillow case.

The pillow case can be folded up and inserted into the first pocket, when the pillow cushion is in the pillow case, such that a majority, or a substantial portion, of the pillow cushion and the pillow case is located in the first pocket. The pillow case can be folded up and inserted into the second pocket, when the pillow cushion is in the pillow case, such that a majority, or a substantial portion, of the pillow cushion and the pillow case is located in the second pocket.

The apparatus may include a first strap attached to the pillow case, wherein the first strap can be used to carry the pillow case and can be used to retain the pillow case in a folded up state. The apparatus may also include a second strap attached to the pillow case, wherein the second strap can be used to carry the pillow case and can be used to retain the pillow case in a folded up state. Additional small straps, loops or snaps can be attached to the first pocket and inside the first pocket to help strap the pillow to another object and or to help hide the strap. In one embodiment a method is provided, which includes attaching a first pocket to a top of a pillow case, and attaching a second pocket to a bottom of the pillow case, the top opposite from the bottom, and locating a pillow cushion in a main inner chamber within the pillow case.

DETAILED DESCRIPTION OF THE DRAWINGS

Figure 1:
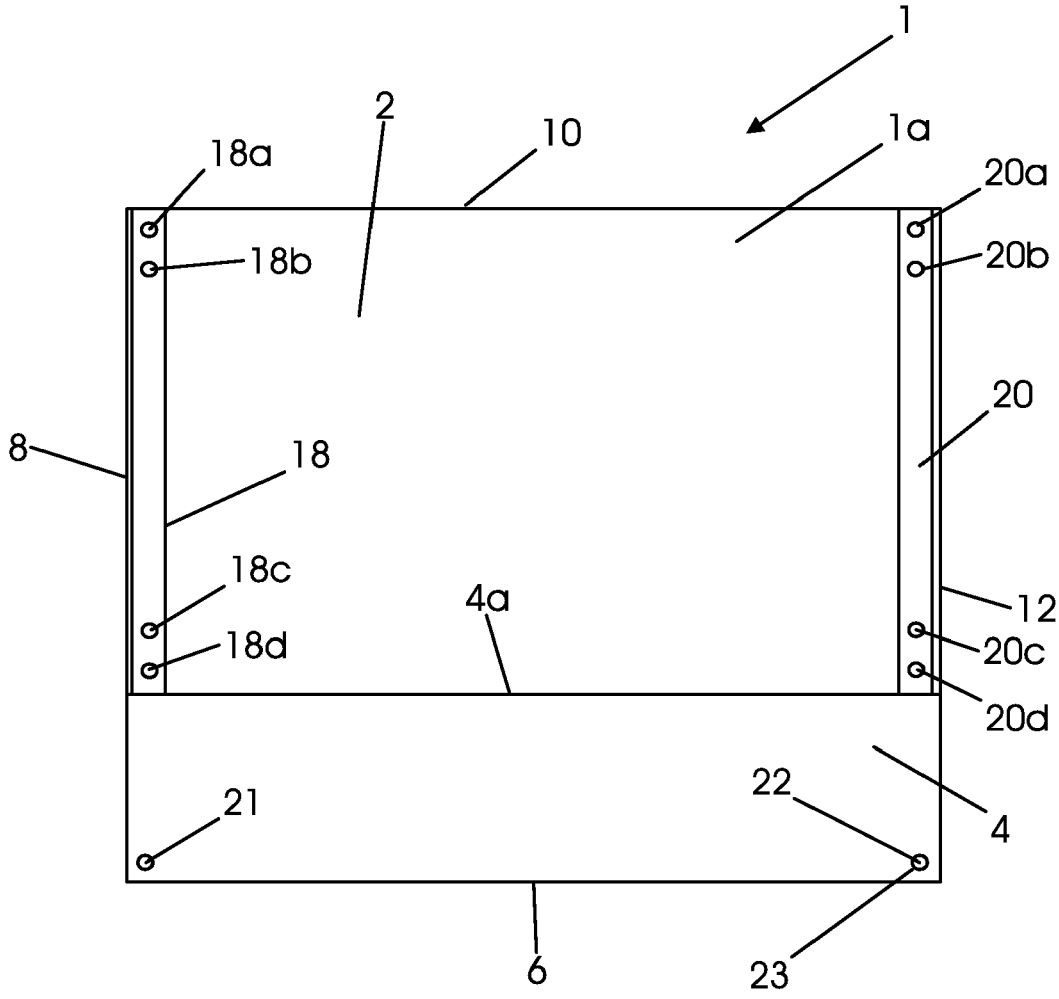
FIG. 1 shows a diagram of a top view of a pillow in accordance with an embodiment of the present invention, with the pillow shown in an unfolded state.
Figure 2:
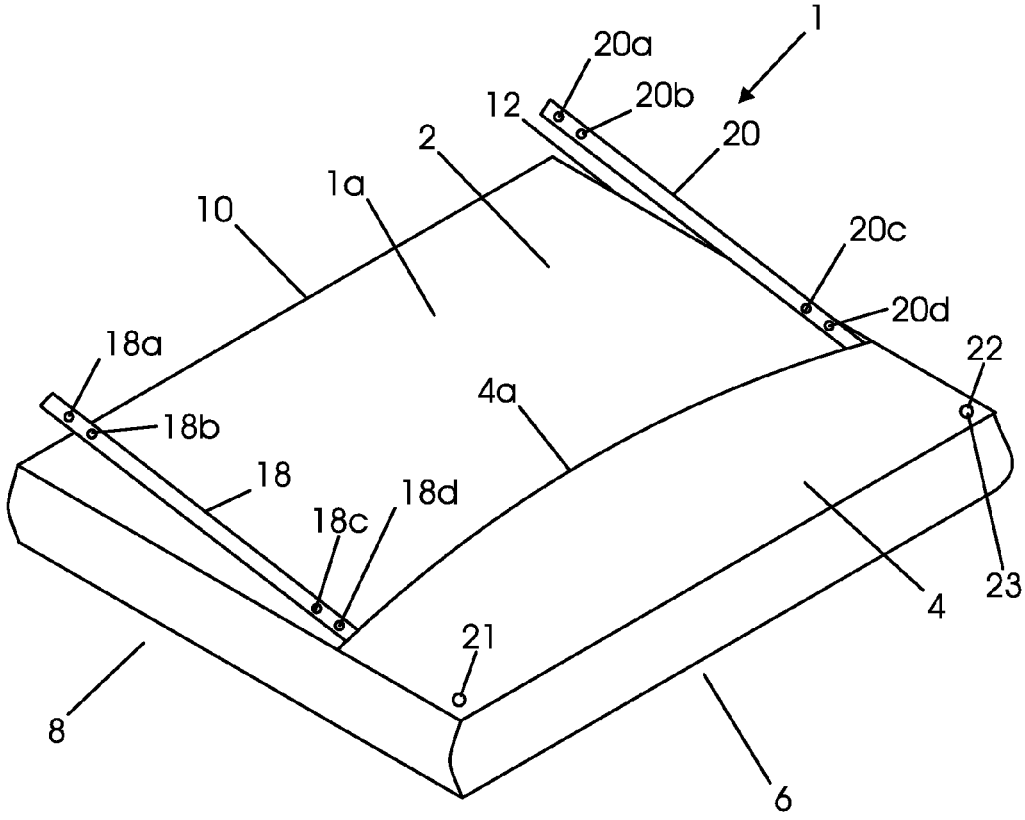
FIG. 2 shows a top front left side perspective view of the pillow of FIG. 1, with the pillow shown in an unfolded state.
Figure 3:
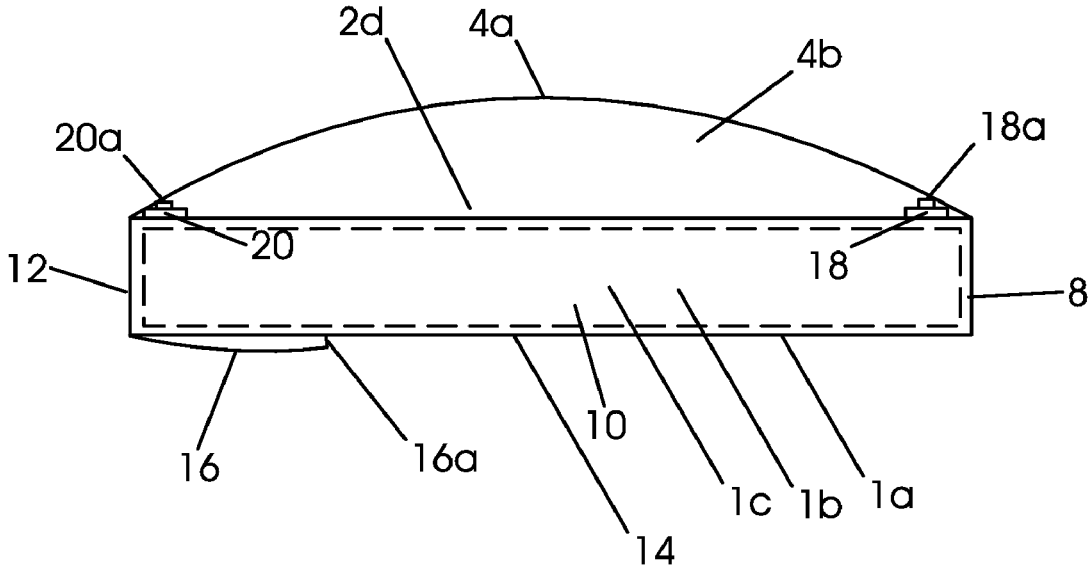
FIG. 3 shows a rear view of the pillow of FIG. 1 with a first flap of the pillow lifted up to reveal a first chamber, with the pillow shown in an unfolded state.
Figure 4:
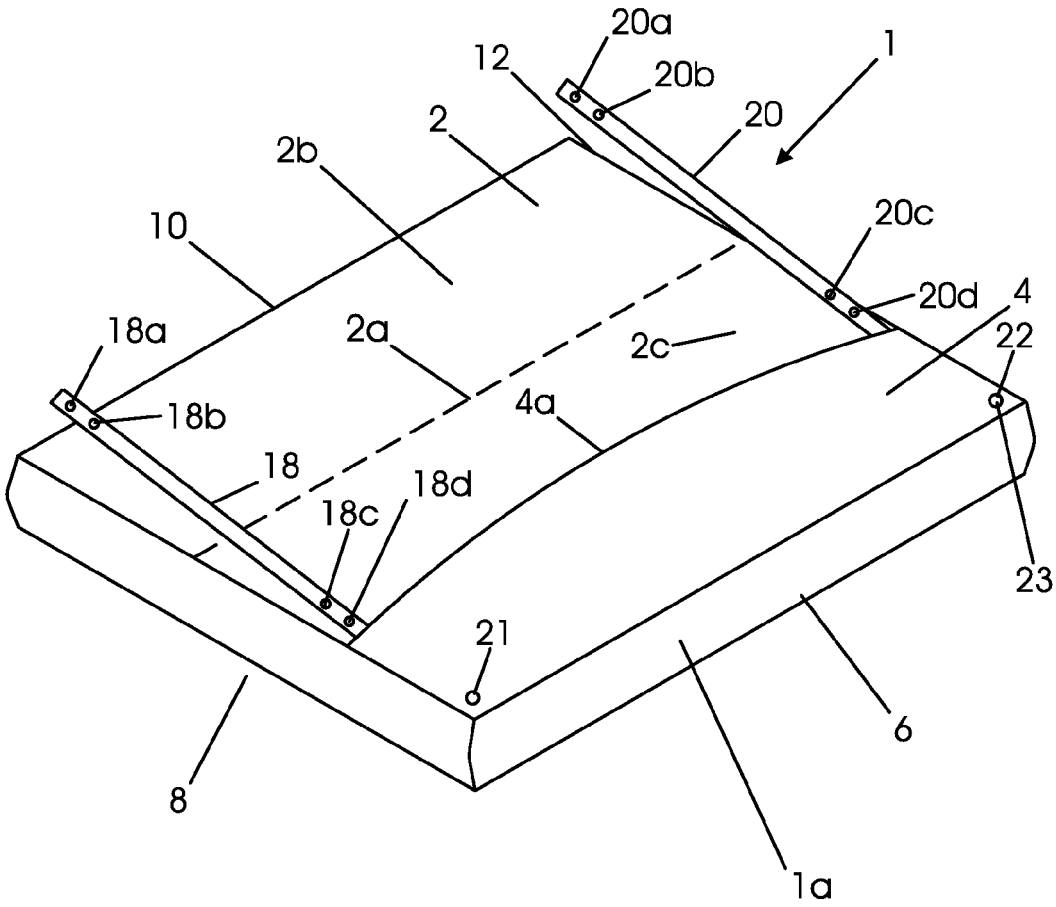
FIG. 4 shows a top front left side perspective view of the pillow of FIG. 1, with a dashed line shown at a location where the pillow can be folded, with the pillow shown in an unfolded state.
Figure 5:
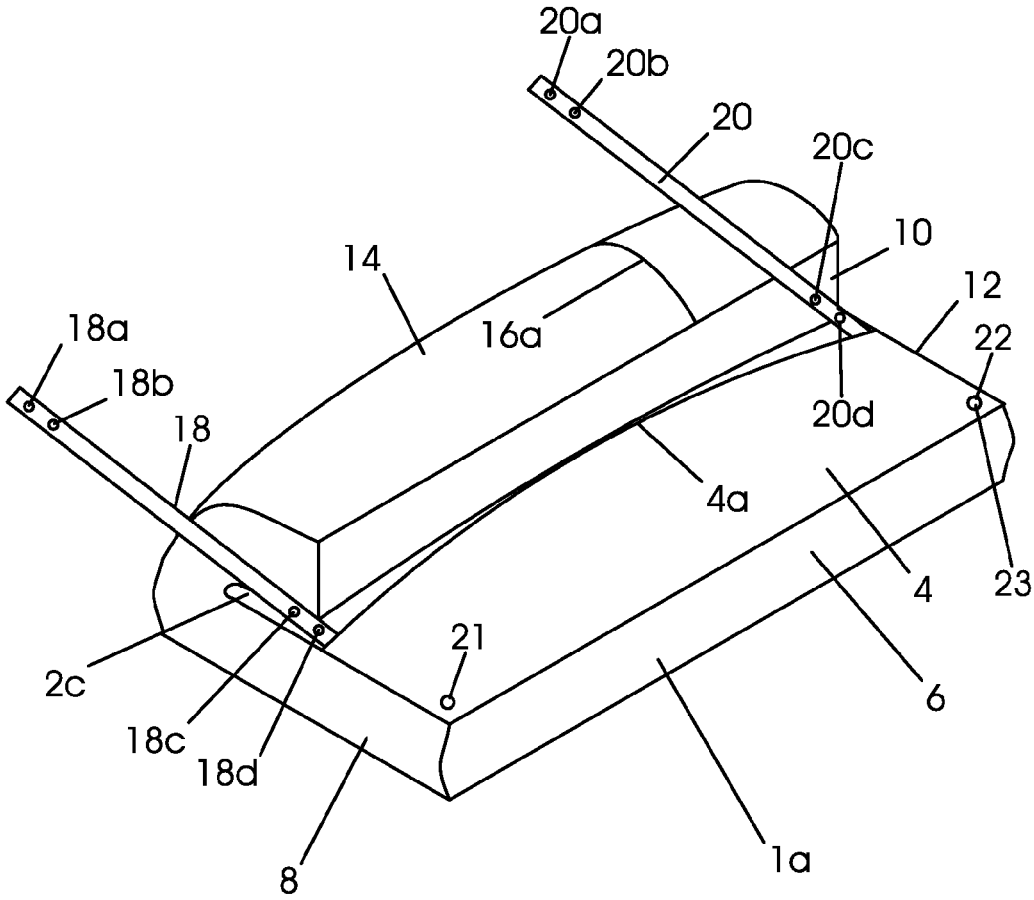
FIG. 5 shows a top front left side perspective view of the pillow of FIG. 1, with the pillow in a once folded over state.
Figure 6:
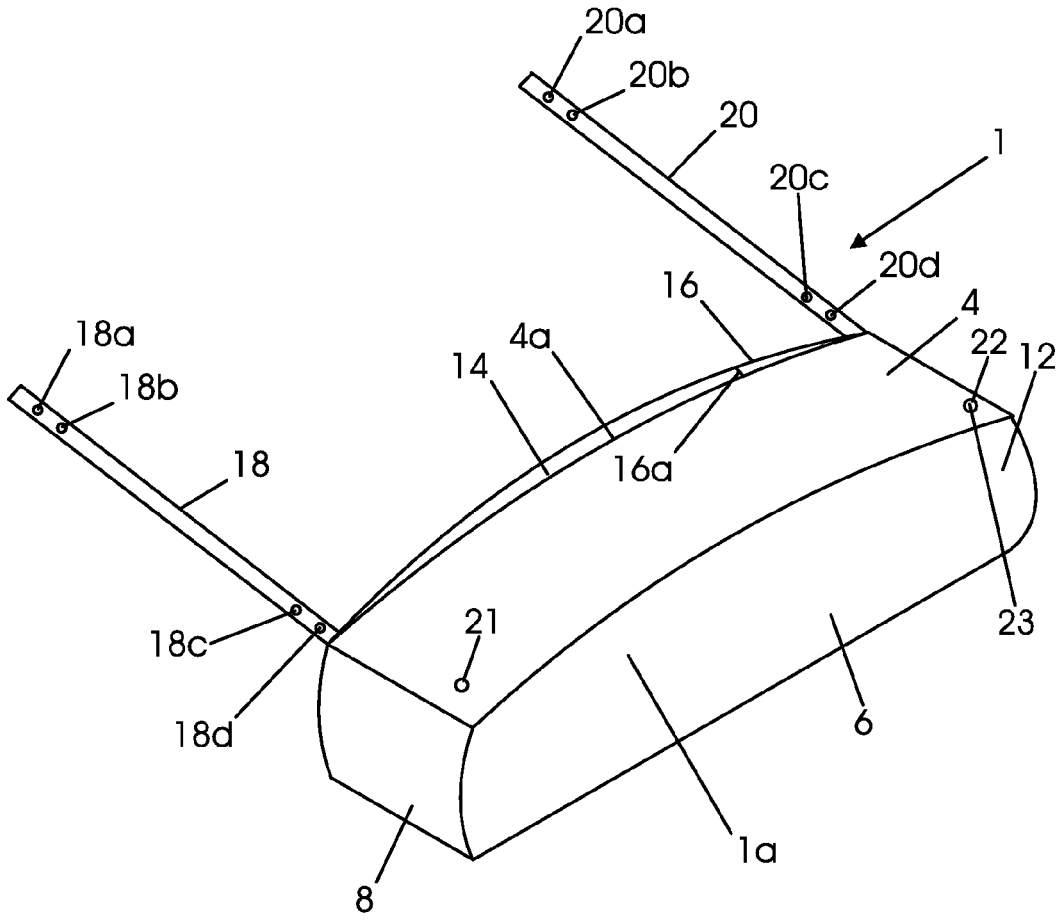
FIG. 6 shows a top front left side perspective view of the pillow of FIG. 1, with pillow folded into thirds and inserted into the first flap.

FIG. 1 shows a diagram of a top view of a pillow 1 in accordance with an embodiment of the present invention, with the pillow 1 shown in an unfolded state. FIG. 2 shows a top front left side perspective view of the pillow 1, with the pillow 1 shown in an unfolded state. FIG. 3 shows a rear view of the pillow 1, with a first flap 4 of the pillow 1 lifted up to reveal a first chamber 4*b*, with the pillow 1 shown in an unfolded state. FIG. 4 shows a top front left side perspective view of the pillow 1, with a dashed line 2*a* shown at a location where the pillow 1 can be folded, with the pillow 1 shown in an unfolded state. FIG. 5 shows a top front left side perspective view of the pillow 1 of FIG. 1, with the pillow 1 in a once folded over state. FIG. 6 shows a top front left side perspective view of the pillow 1, with pillow 1 folded into thirds and inserted into the first flap 4.

Figure 7:
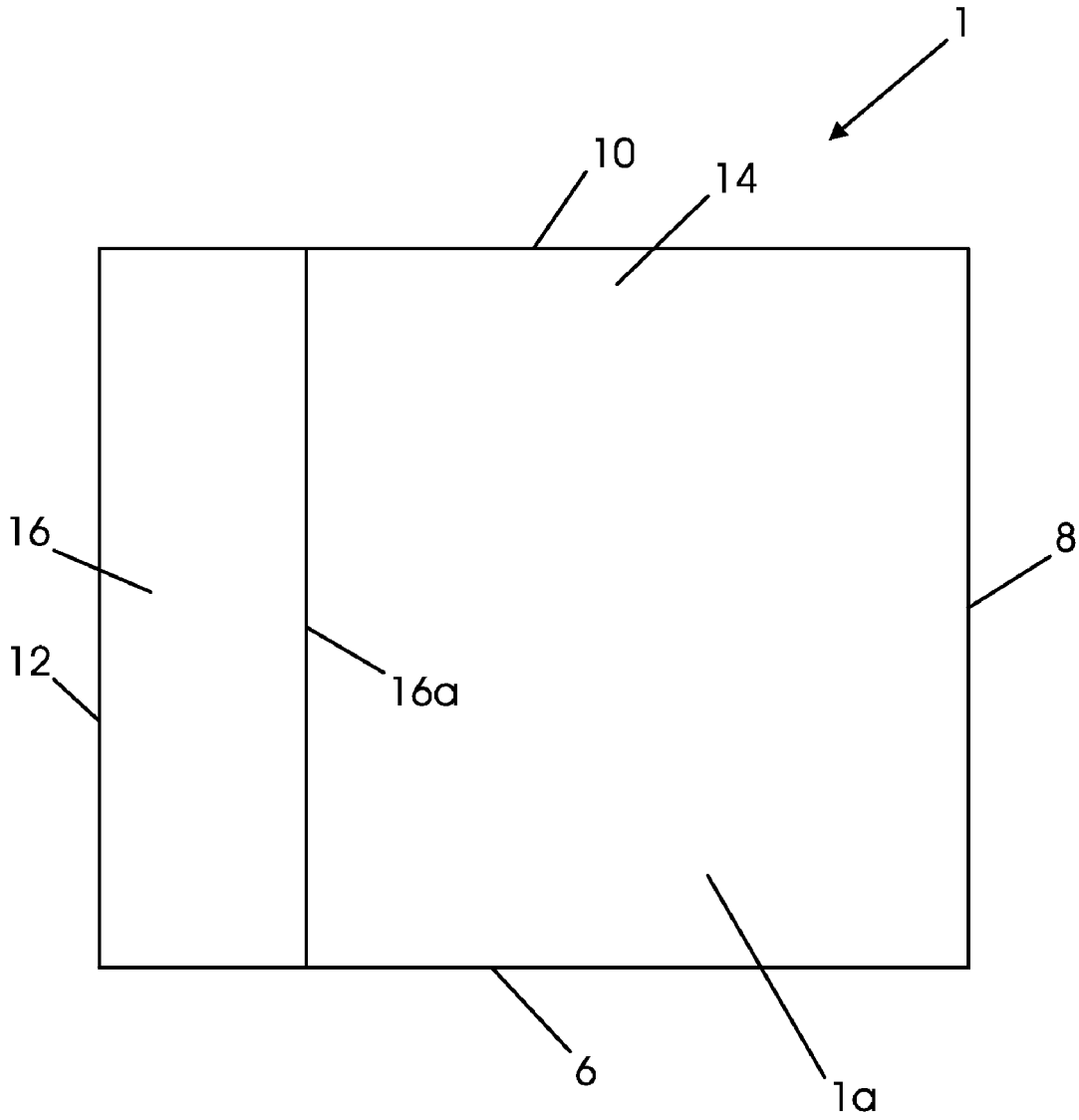
FIG. 7 shows a diagram of a bottom view of the pillow of FIG. 1, with the pillow shown in an unfolded state.
Figure 8:
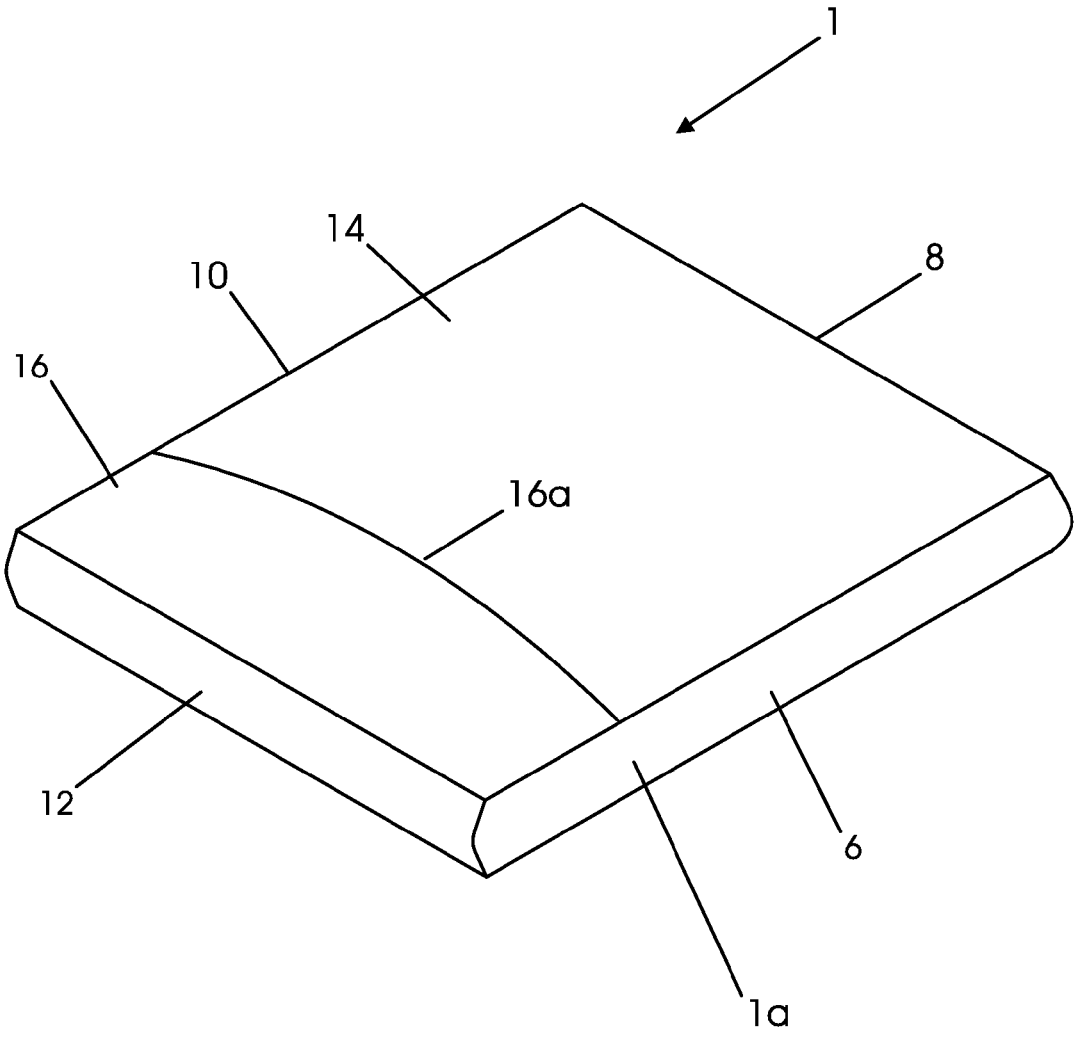
FIG. 8 shows a bottom front right side perspective view of the pillow of FIG. 1, with the pillow shown in an unfolded state.
Figure 9:
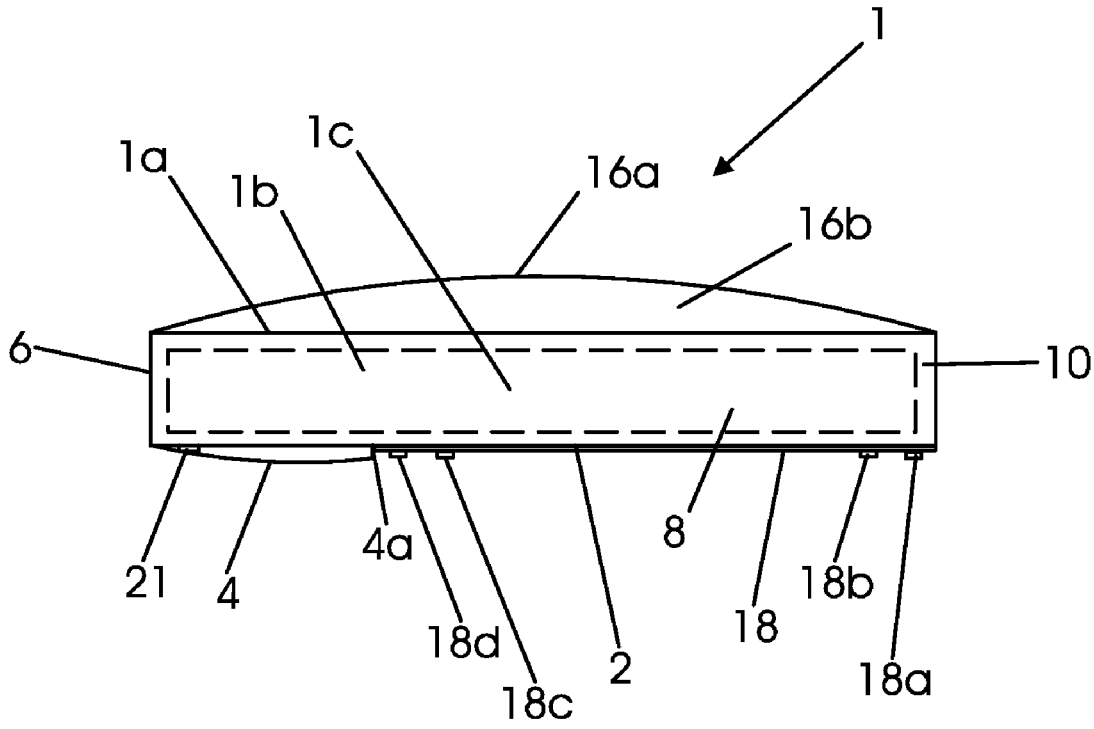
FIG. 9 shows a left side view of the pillow of FIG. 1 with a second flap of the pillow lifted up to reveal a second chamber, with the pillow shown in an unfolded state.
Figure 10:
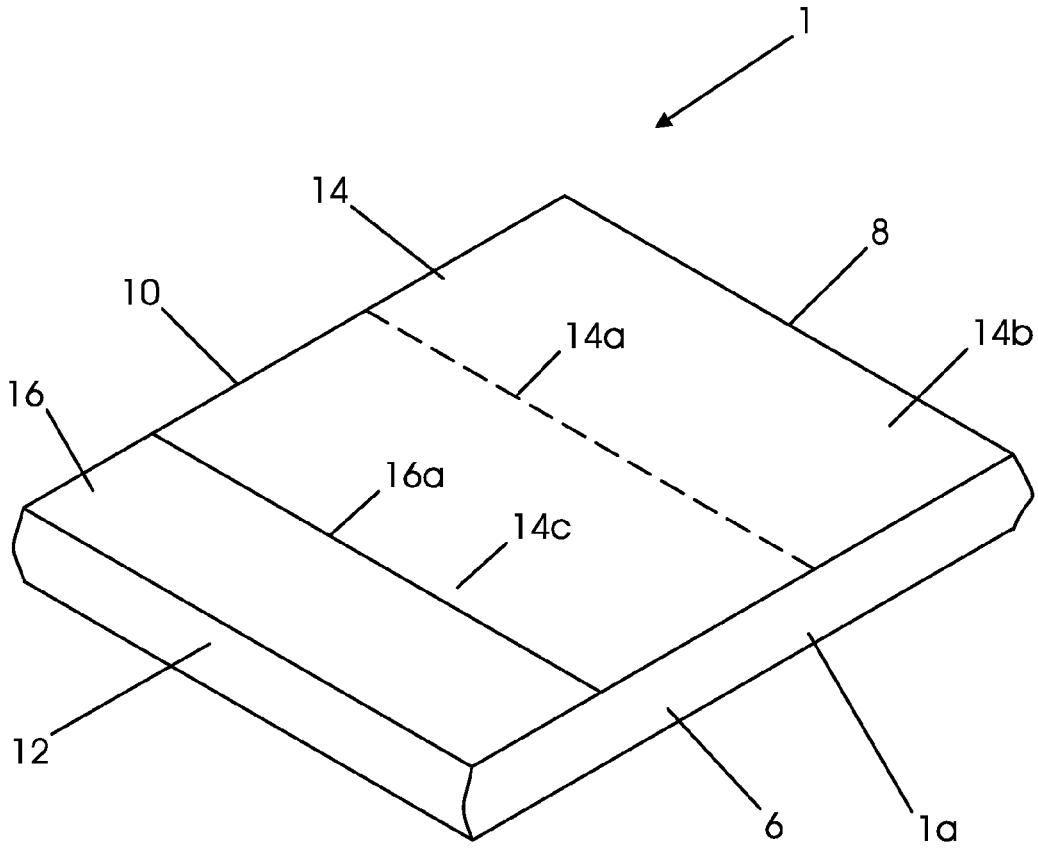
FIG. 10 shows a bottom front right side perspective view of the pillow of FIG. 1, with a dashed line shown at a location where the pillow can be folded, with the pillow shown in an unfolded state.
Figure 11:
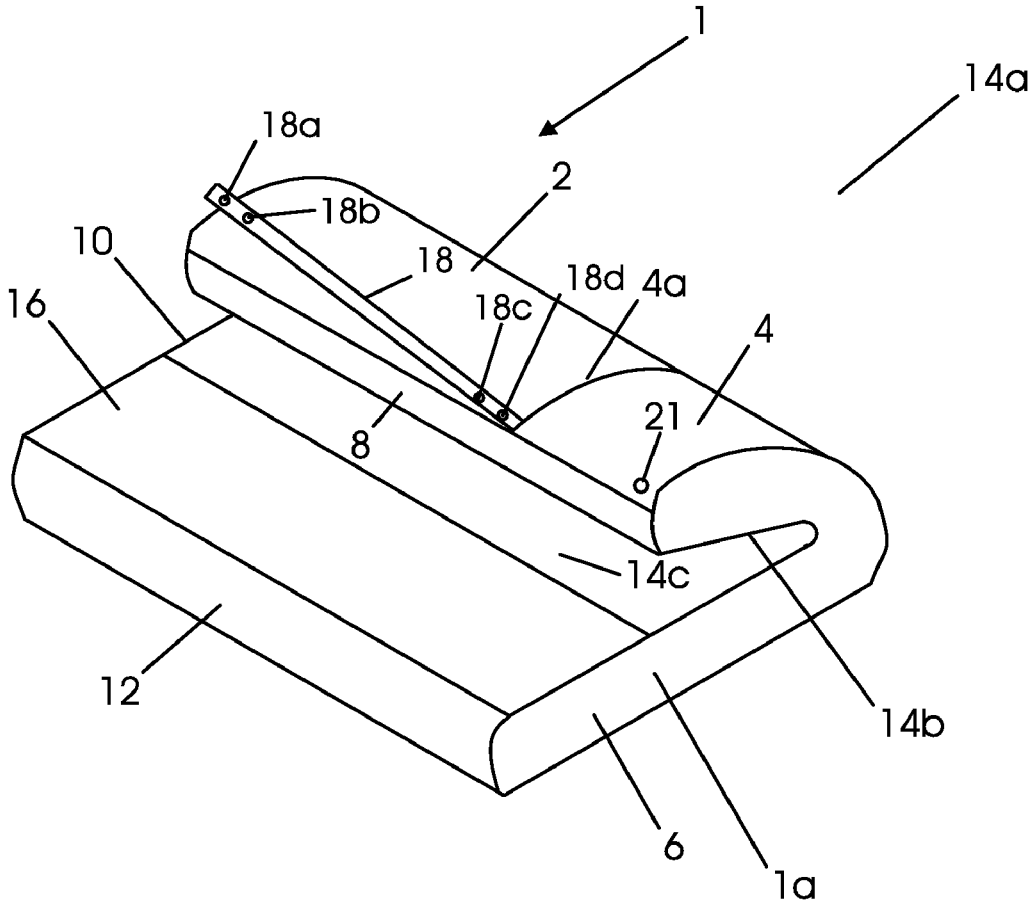
FIG. 11 shows a bottom front right side perspective view of the pillow of FIG. 1, with the pillow in a once folded over state.
Figure 12:
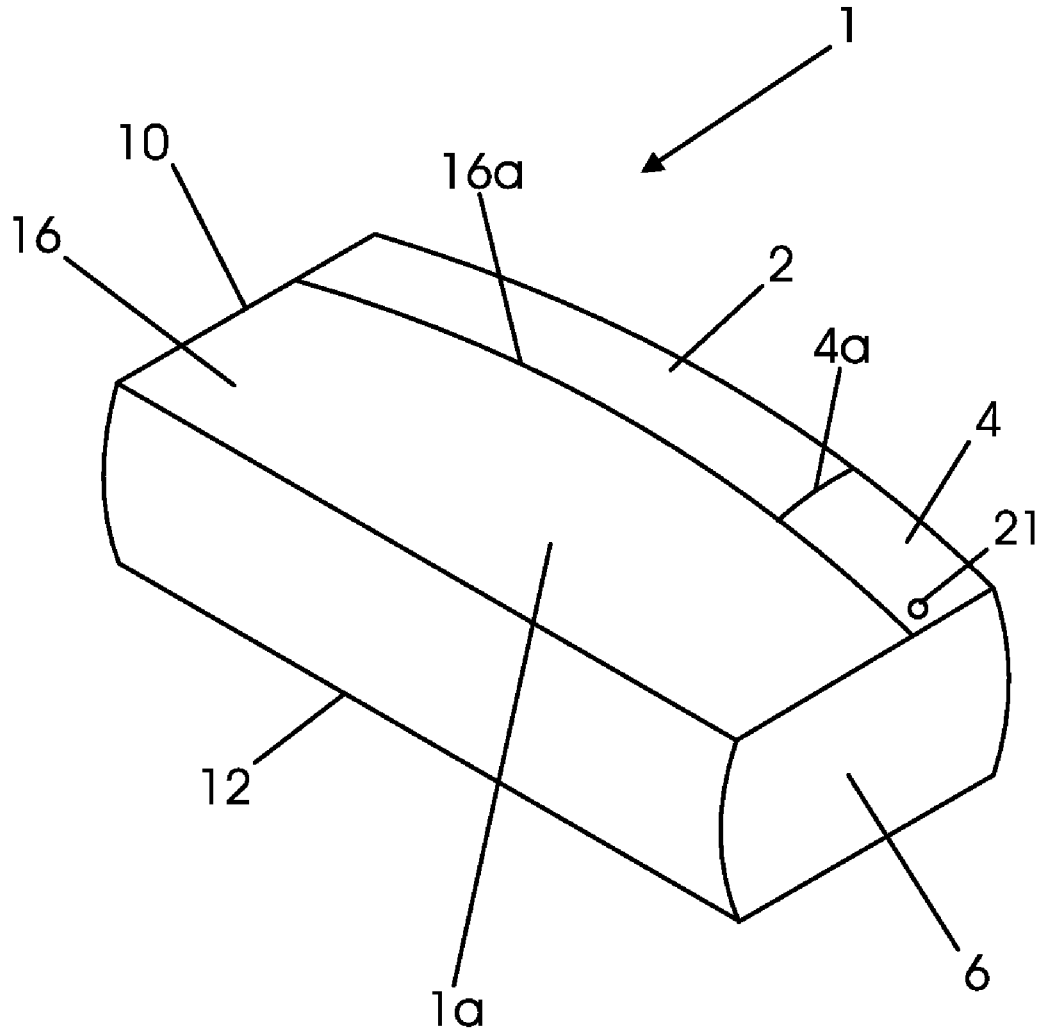
FIG. 12 shows a bottom front right side perspective view of the pillow of FIG. 1, with pillow folded into thirds and inserted into the second flap.

FIG. 7 shows a diagram of a bottom view of the pillow 1, with the pillow shown in an unfolded state. FIG. 8 shows a bottom front right side perspective view of the pillow 1, with the pillow 1 shown in an unfolded state. FIG. 9 shows a left side view of the pillow 1 of FIG. 1 with a second flap 16 of the pillow 1 lifted up to reveal a second chamber 16*a*, with the pillow 1 shown in an unfolded state. FIG. 10 shows a bottom front right side perspective view of the pillow 1 of FIG. 1, with a dashed line shown at a location where the pillow 1 can be folded, with the pillow 1 shown in an unfolded state. FIG. 11 shows a bottom front right side perspective view of the pillow 1 of FIG. 1, with the pillow 1 in a once folded over state. FIG. 12 shows a bottom front right side perspective view of the pillow 1, with pillow 1 folded into thirds and inserted into the second flap 16.

The pillow 1 includes front 6, left side 8, right side 12, and rear 10, as shown by FIGS. 2 and 8. The pillow 1 further includes the top 2 and the bottom 14 shown in FIGS. 2 and 8, respectively. The pillow 1 also includes the pockets, flaps or pouches 4 and 16, shown in FIGS. 2 and 8, respectively. Pouches 4 and 16 have edges 4*a* and 16*a*, and chambers 4*b* and 16*b*, shown in FIGS. 3 and 9, respectively. The dashed lines 2*a* and 14*a* are not part of the pillow 1 and are used for descriptive purposes.

The pillow 1 includes straps 18 and 20 shows in FIGS. 1-6. The straps 18 and 20 include snaps or fasteners 18*a-d* and 20*a-d*, respectively. The snaps 18*a-d* may face up in FIG. 6 and the snaps 20*a-d* may face down and/or be on the other side of the strap 20 (the side not shown in FIG. 6)

The pillow 1 in a folded up form as shown in FIG. 6 or in FIG. 12 can be used as a lumbar support.

The pillow 1 can be folded up in the following manner. The pillow 1 can be placed flat and in an unfolded state, with the pocket or flap 4 facing up as in FIGS. 1 and 2. The pillow 1 can be placed so that a user is near the rear side or portion 10. The pillow 1 can then be folded into thirds by a human user by grabbing the sides of a section 2*b* of the top 2 and folding section 2*b* on top of section 2*c*, as shown in FIG. 5. The pillow 1 may be folded into thirds, so that section 2*b* may be about a third of the top 2, section 2*c* may be about a third of the top 2, and a section 2*d* (see FIG. 3) underneath the flap 4 may be about a third of the top 2. With the section 2*b* folded on top of the section 2*c*, the two sections 2*b* and 2*c*, may then be folded on top of the section 2*d* underneath the flap 4. Thus the sections 2*b* and 2*c* will be at least partially inside the chamber 4*b* of the pocket or flap 4.

The pillow 1 may include a cushion 1*c*, inside a main inner chamber 1*b*, shown within dashed lines in FIGS. 3 and 9, of a pillow case 1*a*. The cushion 1*c* lies inside of the pillow case 1*a*. The main inner chamber 1*b* is surrounded or substantially surrounded by the front 6, left side 8, right side 12, rear 10, the top 2 and the bottom 14 so that the cushion 1*c* is completely enclosed or substantially enclosed in the main inner chamber 1*b*. The pillow case 1*a* may have a length, such that the distance from left side 8 to right side 12 may be twenty-six inches. The pillow case 1*a* may have a width such that the distance from front 6 to rear 10 may be twenty inches. The flap 4 may have a width, from the edge 4*a* to the front 6, of about five to six and ⅔ inches (or ¼ to ⅓ the width from the front 6 to the rear 10). The flap 16 may have a width, from the edge 16*a* to the right side 12 of about six and ½ to eight and ⅔ inches (or ¼ to ⅓ the width from left side 8 to right side 12). The flap 4 thus may be twenty-six inches in length and about five to six and ⅔ inches, while the flap 16 may be twenty inches in length and six and ½ to eight and ⅔ inches. The Inside flap or pocket 16 close to where 2 and 14 may meet at right side 12 can be sewn together, left open, or a closing devise i.e. zipper can be included. In one embodiment, the top 2 and the bottom 14 may connect to each other directly, sewn closed at their edges, while still creating a main inner chamber 1*b*, so that the cushion 1*b* is permanently encased by case 1*a*. In a second embodiment, the case 1*a* can be left open where 2 and 14 may meet at right side 12 so that pillow cushion 1*c* can be removed. In a third embodiment, where 2 and 14 may meet at right side 12 a closing and opening devise i.e. zipper can be attached to keep cushioning material securely in the case 1*a*. If case 1*a* is open pillow cushion 1*c* can be easily be replaced. Another cushion or other objects i.e. clothes, towels etc. can be used in place of pillow cushion 1*c*. So as to allow hikers, campers, or other travelers to carry less and still have the benefit of a pillow. Any object(s) of pliable material that helps cushion can be used when cushion 1*c* is not available.

The pocket or flap 16, which is typically smaller in length than flap 4 (such as twenty-inches versus twenty-six for flap 4), but larger in width than flap 4, provides more support by allowing for a greater thickness or firmness of folded pillow, by having more folds or more pillow material (and/or more interior cushion) of the pillow 1 tucked underneath a smaller length pocket.

In one embodiment, the pillow 1 can be rolled instead of folded into the flap 4 or into the flap 16. A rolled pillow can be used as a neck roll for cervical support, the tighter the roll the firmer the support. The pillow 1, in either a folded form or a rolled form can be used with a traditional pillow, so that the pillow 1 supports a person's neck and the traditional pillow supports the person's head and shoulders. If rolling, the pillow 1 proves to be too large a fit then folding pillow 1 in thirds might work better.

The cords or straps, 18 and 20, shown in FIGS. 1-6, can be used to hold the pillow 1 in a folded up state or to carry the pillow 1. For example, after the pillow 1 is folded or rolled into the state shown in FIG. 6 or FIG. 12, the cords or straps 18 and 20 can be tied to hold around the neck or carry on the shoulder. The fasteners or snaps 20*a* and 20*b* can be snapped and or connected to the fasteners or snaps 20*c* and 20*d*, respectively. After the pillow 1 is folded into the state shown in FIG. 6, it can then be folded again and strapped by cords or straps 18 and 20 to luggage. This can be done by orienting the pillow 1 in its folded up or rolled up state of FIG. 6, so that the underside (i.e. the part of bottom 14 opposite from the pocket 4) is facing up, and then folding the pillow 1 in half, so that side 8 now touches or is in close proximity to side 12. Side 8 can then be tucked into pocket 16. Strap 20 will allow any folded form to be strapped to luggage. Small strap, loop, or snap 23 may be located or attached on the outside of flap or pocket 4 near the corner where sides or edges 6 and 12 meet, almost at the same location as 22, but on the outside of flap 4. Small strap 23 can be used to aid loop 20 so it forms a tighter loop that can strap to luggage.

Small straps, loops, snaps, pieces of Velcro (trademarked), or other similar devices, may be located and attached inside flap or pocket 4 near the corner where sides or edges 6 and 12 meet and near the corner where sides or edges 6 and 8 meet. FIGS. 1-2, and 4-6 show the small straps, loops, or snaps 21 and 22 except that it should be understood that 21 and 22 typically would be inside of the pocket 4 (not on the outside as shown in FIGS. 1-2). FIG. 9 shows a see through version of flap 4, with 21 shown properly inside of the flap or pocket 4. The large straps 18 and 20 can be attached to the small straps 21 and 22 (inside of the pocket 4) and thus stored in the pocket 4. The straps 18 and 20 may be attached inside the chamber 4*b* of the flap or pocket 4 or the portion 2*d*.

The pillow 1 can be placed in a cervical roll pillow configuration (not shown). The forms folded versus rolled as in FIGS. 6 and 12 will also work in some cases. These configurations can be used tucked underneath the neck while sleeping on one's side or back. A standard bed pillow can be used with this form to add comfort. The standard pillow will support the head and shoulders. The extra pillow will keep pressure off the shoulder in a side lying position. The user will have the benefit of a customized pillow at a low cost. If no additional pillow is available a thicker fold/roll should be configured with pillow 1 for the side lying position. Pre-molded cervical pillows can be expensive and are not comfortable for all. Using a cervical pillow, helps individuals to sleep and breathe better, because of better cervical alignment. The theory here is that while the head needs support it is the neck that is most vulnerable to injury, discomfort, or stiffness, so it too should have a focus of support. Additionally, when the neck is bent or in awkward alignment the airway is constricted and this is thought to be a factor in the cause of snoring and congestion. A pillow form such as the form or state in which pillow 1 has been placed in FIG. 6 or 12 can be used underneath the waist or the small of the back while a user sleeps/rests on their back to support the user's lumbar region.

The straps or cords 18 and 20 should be tucked away securely inside the flap or pockets 4 when not in use. The straps 18 and 20 can be connected to the inside or chamber 4*b* of the flap 4 by having the straps 18 and 20 snapped on or sewn on. If the straps 18 and 20 have been snapped on to pillow 1 then they can be snapped off. If the pillow 1, including pillow case 1*a*, is going to be used by children, typically the straps 18 and 20 would be snapped off or cut off to prevent the child from injuring him/herself.

The pillow 1 can also be used like a U-shaped travel pillow. The pillow 1 would be laid flat as in FIGS. 1 and 2, with the widest width (typically twenty-six inches) left to right in front of a user. The user would typically be at the rear 10 shown in FIG. 2, i.e. the pocket or flap 4 would be away from the user. The cords/straps 18 and 20 would then be pulled from under the pocket or flap 4 out to the sides 8 and 12 as shown in FIG. 1. A user can then snugly roll the rear 10 of the pillow 1, nearest the user, into the chamber 4*b* of the pocket or flap 4. The pillow 1 is thereby put into a rolled up or roll state. The roll (or pillow 1 in the rolled state) can then be bent into a "V" shape by pulling the two cords or straps 18 and 20 together and wrapping the pillow 1 in the rolled up state around an individual's neck and the pillow 1 straps can be tied/snapped tight enough so that the rolled up pillow 1 or roll stays in place, but is still comfortable.

An individual can carry the pillow using the straps 18 and 20. The user can follow the instructions for using as a U-shaped travel pillow and in that case would not tighten into a V-Shape. The user can then tie/snap straps 18 and 20 together so that the rolled up pillow 1 with the cord/straps can be strapped over the shoulder and carried.

In one embodiment, an individual can fold the pillow 1 into traditional type travel pillow. The individual would lay pillow 1 with the widest width left to right, as shown in FIG. 8, and the smaller pocket (in length) 16 facing up on the left. The user would then fold in half toward the left and tuck the right end of the cushion into the pocket. The user would then flip the pillow 1 (now folded in half) over so that the pocket 4 is facing furthest to the user on top. The user would then fold the end closest to the user into the pocket 4. The pillow 1 in this embodiment is thus folded into fourths and resembles a child's pillow.

When no additional pillow is available a user can also use the pillow 1 to create a thicker pillow for a side head rest. The user would first fold the pillow in thirds and insert into pocket 4 as in FIGS. 4-6, and then the user would flip over, and fold in half and tuck snugly into the small pocket 16. This form can also be used as an arm rest.

The cushioning material 1*c* inside the pillow 1 is typically of a pliable type. It can be firm or fluffy. The external or case fabric, for the pillow case 1*a* should be of a soft fiber and it should be washable too. The pillow 1 may be comprised of at least five parts used to construct it: (a) the cushion (foam, batting etc.)—not shown (b) the smaller length pocket 16 shown in FIG. 7, (c) the larger length pocket 4 shown in FIG. 1 (d) the top fabric 2 shown in FIG. 1 (e) the bottom fabric 14 shown in FIG. 7. Additional parts can be added such as aid devices—cords, loops, snaps or straps 18 and 20 to aid in carrying or wearing the pillow 1, shown in FIGS. 1-6. Pockets 4 and 16 can also contain elastic, a draw string or other devices to help keep it taut and hold the folded pillow in place. Closing or attaching devices such as zippers, Velcro, snaps or other method can be used to hold parts together. Additional fabric can be added to pockets 4 and/or 16 to wrap around the pillow and act as a protective cover FIG. 13.

The pillow 1 is to medical providers and care givers who have patients with varying needs for comfort support. The present invention can be used in one or more folded up forms or states (such as the state of FIG. 6 or the state of FIG. 12) to help prop up the patient. For example, the folded up forms of pillow 1 can provide thick compact support so as to elevate and drain a swollen hand. Massage therapists can more comfortably massage a hand or foot in an elevated position. People with spinal distortions might benefit from additional cushioning to an isolated area of their back, hips, or shoulders, so it is desirable to have a pillow that adapts to varying conditions as pillow 1 can.

Someone with a gluteus or tail bone problem might fold the pillow 1 and place it under their thighs to prevent pressure in the affected area as they sit. While the pillow 1 might start out as only one inch in its unfolded form of FIG. 1 and FIG. 2, the pillow 1 can be made to be two, three, four, or more inches thick depending on how it is folded or rolled. This creates an advantage, because the user can find the configuration that will help them. It's a cushion, for whatever purpose one might need a cushion.

The pillow 1 may include a pillow case 1*a* and a pillow inside or cushion material 1*c* shown by dashed lines in FIG. 3. The pillow case 1*a* may be constructed to receive a proportionately thin, i.e. one, inch soft fabric cushion (not shown) that can be folded or rolled. The material for the inside cushion can be cut so that the finished size is approximately the same width and length of a traditional bed pillow, but size can vary. A pocket, such as pocket or flap 4 is sewn on to the top 2, as shown in FIG. 4, and a pocket or flap 16 is sewn onto the bottom 14 as shown in FIG. 10 to form the pillow case 1*a*. One pocket, such as 4 is sewn along the long edge (such as twenty-four to twenty-six inches) of one side of the pillow case 1*a* so that the pocket or flap 4 sits on the backside and the other pocket, such as 16 is sewn along the shorter edge (such as about eighteen to twenty inches) of the opposite side (or bottom 14) of the pillow case 1*a* so that it also rests on the outside of the pillow case 1*a*. The way the pockets 4 and 16 are sewn on to the case creates an "L" shape, i.e. the longest dimension of the pockets 4 and 16 are substantially at a right angle with respect to each, but the two are on the opposite sides (one on the top 2 and one on the bottom 14) of the pillow case 1*a*, so that they only touch at the seam (such as at side 12 shown in FIGS. 4 and 10).

Cords or straps, 18 and 20, can be sewn inside each end of the widest width pocket, such as pocket 4, to be used as a tie for carrying or to help hold/wear the pillow 1 as the user rests—a clasp or fastener may also be included, such as fasteners 18*a-d* and 20*a-d*, to hold the cords or straps together for carrying. Once the cushioning material is inserted into the pillow case 1*a*, the pillow 1 (including cushion and pillow case 1*a*) can be folded or rolled in various ways to create a variety of pillows. Folding and tucking the cushion 1*c* and the pillow case 1*a* into the pocket(s) 4 and/or 16 or strap(s) 18 and 20 forms the shape and holds the pillow 1 in place.

The cushioning material (not shown) can vary. Bonded or non-bonded batting (poly fiber/down alternative), foam rubber (open or closed cell), an air cushion or any other type of pliable material can be used. The fabric used for the casing should be soft, washable, and with or without elasticity, but fabric with some give is best. The combination of material is important for maintaining the different shapes.

The following may be a travel size or alternate version of the pillow 1. The pillow case 1*a* can be comprised of two pieces of fabric, the top 2 and the bottom 14 of FIGS. 2 and 8, cut to twenty-four and ¾" by eighteen and ¾". The pocket 4 can be a piece of fabric cut to measure twenty-four and ¾" by four and ½" to 6 inches. The pocket 16 can be a piece of fabric cut to measure eighteen and ¾" by six to eight inches.

Two pieces of thin cords can be used for 18 and 20 and be can be cut to measure fifteen inches long each (for tie). If straps are preferred for 18 and 20, then an individual can cut straps for 18 and 20 which are each one inch by fifteen inches and then can sew to make part of the pillow case 1*a* and/or pillow 1. One piece of fabric (for strap 20) cut to measure one inch to one and one-half inches by eight or fifteen inches. To aid strap 20, small strap/loop 22 can be created with a one inch by one-half inch piece of cut fabric. This small strap/loop 22 can be attached inside flap 4 near edge of 6 close to or including edge 12. If strap 20 was cut to 8 inches attach a snap instead of the small strap to flap 4. Another piece of fabric (for strap 18) can be cut to measure one to one and one-half inch by fifteen inches. Metal or plastic snaps (such as one-half inch), a sixteen inch zipper and foam or batting cut to twenty-four by eighteen inches are also be used to complete the pillow.

The travel version can also include a protective cover (not shown). The protective cover may be added by attaching additional fabric to pocket chamber 4*b* or 16*b*. The additional piece can also be attached to straps 18 and or 20, if this method is preferred. The fabric should be of a thin water resistant type. The protective cover can be pulled out of the pocket and wrapped around the pillow to protect it from dirt and rain. The fabric can be cut to measure at least the length and at least twice the width of pocket 4 or 16. The fabric is cut to a size that will allow the entire pillow cushion to be covered. Fastener or straps can be used to hold the cover in place.

One or more embodiments of the present invention provide a pillow apparatus and method which has many advantages. For example, pillow 1 allows the user to fold/roll and tuck to create a variety of pillow configurations and at the same time adjusts the thickness and firmness. It saves storage space. It can easily be stored in different compartment sizes. The pillow 1 can be folded or unfolded so it fits. The pillow 1 can eliminate the need to have several pillows for different circumstances. It is easy to handle and alter. The pillow 1, in at least one embodiment, can be compact. It can be light weight. As a travel pillow, pillow 1 works well, since it is compact and can serve various needs. It can serve as a cervical pillow, a lumbar support a headrest or a seat cushion and it can easily be altered and used in a cramped space. The pillowcase 1*a* can be used without the pillow cushion 1*c*. Clothes or other pliable material found in a luggage/backpack can be stuffed inside the case 1*a*, taking the place of the pillow cushion 1*c* and allowing the user to travel light. It can be easily transported in a suitcase or strapped to luggage. The user can also carry the travel version strapped across their back or on the shoulder leaving them with their hands free. Many prior art pillows are more difficult to carry, store and are more limited in use. The user doesn't always know in advance what comfort or support need they will experience, so pillow 1 has the advantage that it allows the user to adjust the pillow according to changing needs. The user can decide what shapes the pillow takes, since the pillow can easily and quickly be reconfigured if the need arises. The pillow 1 can also be used as a decorative pillow for the home or office. When reversible fabric is used, pockets 4 and 16, if desired, can be turned inside out and pillow 1 can be folded/rolled, so that the other pocket (i.e. 4 or 16) does not show. In FIGS. 6 and 12, both pockets 4 and 16 can be seen. The reversible pocket can also help to protect the pillow 1 from dirt. The reversible pocket embodiment can help create different designs. Pillow 1 provides a low cost pillow that can be used in a multitude of situations. It is easy to handle or adjust while traveling and in cramped conditions.

Figure 13:
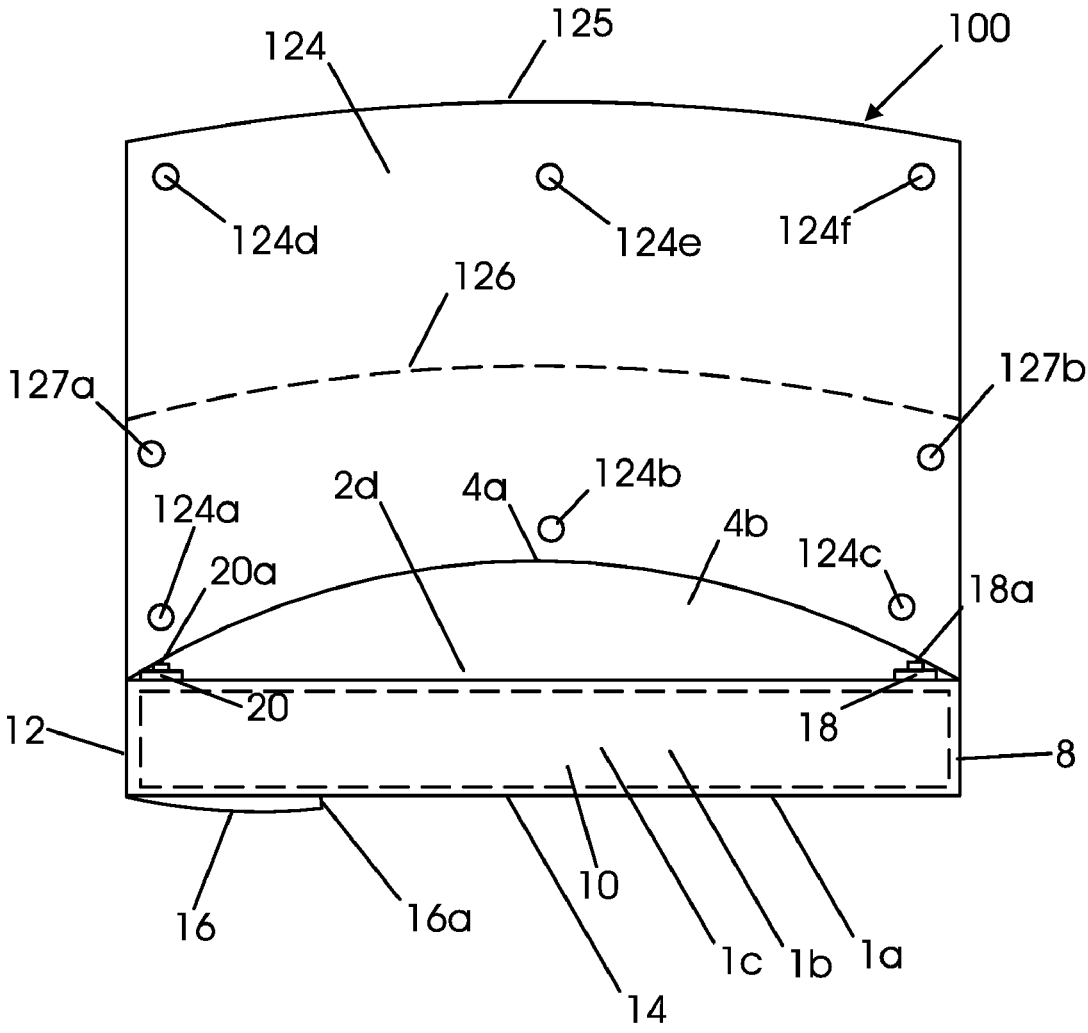
FIG. 13 shows an apparatus in accordance with another embodiment of the present invention.

FIG. 13 shows an apparatus 100 in accordance with another embodiment of the present invention. The apparatus 100 includes the apparatus 1 of FIGS. 1-12 and a cover 124 which can be attached to the edge 4*a* of the pocket 4. The cover 124 includes attachment devices such as snaps, straps, or loops 124*a-f*. When the apparatus 1 is in the state shown in FIG. 6 the cover 124 can be wrapped around the apparatus 1 in order to cover the apparatus 1. In order to wrap, an edge 125 of the cover 124 can be placed around the apparatus 1 in the state of FIG. 6 until the edge 125 meets with the edge 4*a* of pocket 4, and encloses apparatus 1. Then the attachment devices 124*d-f* can be attached to the attachment devices 124*a-c* respectively. The cover 124 can be provided separately or sewn onto edge 4*a* of pocket 4. The cover 124 can be attached to the pocket 4 with attachment devices such as snaps, or Velcro (trademarked). The cover 124 can be attached to 4, 2, 18, or 20 in chamber 4*b*. When not in use cover 124 can, for instance, be folded along the perforated line 126. The attachment devices 124*d-f* can then be attached to the attachment devices 124*a-c*. The cover 124 can be tucked completely into chamber 4*b* or inside pocket 4. To further secure cover 124 in chamber 4*b* the attachment devices 21 and 22 can be secured to attachment devices 127*a* and 127*b*, respectively. The cover 124 stored in the chamber 4*b* of the pillow 1 will help prevent loss of the cover 124.

Figure 14:
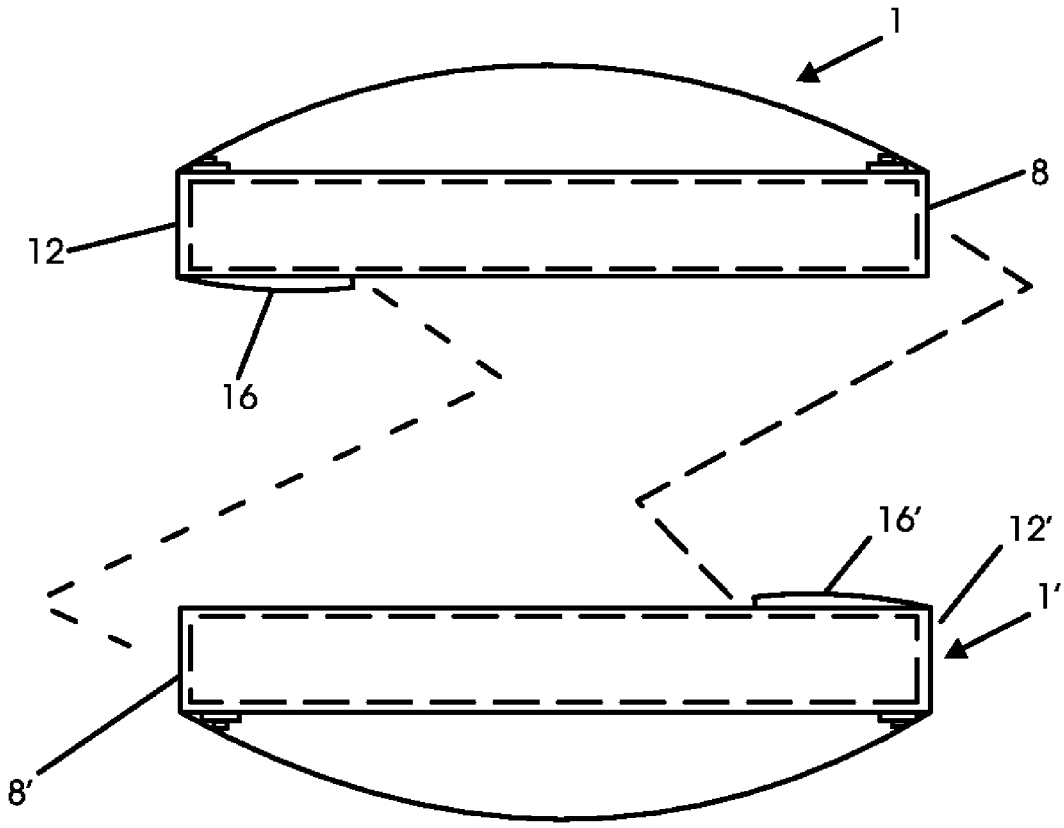
FIG. 14 shows a method of joining two pillows in accordance with another embodiment of the present invention.

FIG. 14 shows pillow or apparatus 1 and a second identical pillow or apparatus 1'. In accordance with another embodiment of the present invention, the pillows 1 and 1' can be joined together. For example, a side or edge 8' of pillow 1' can be inserted into the pocket 16 of pillow 1, while at the same time a side or edge 8 can be inserted into the pocket 16' of pillow 1'. The combination of pillow 1 and pillow 1' can then be folded in half and then the sides or edges 12 and 8' can also be inserted into the pocket 16' to make a more compact combination pillow. This configuration can, for instance, be used as extra bed pillow.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A method comprising attaching a first pocket to a top of a pillow case;

attaching a second pocket to a bottom of the pillow case, the top opposite from the bottom;

locating a pillow cushion in a main inner chamber within the pillow case;

inserting a first substantial portion of the pillow case and the pillow cushion into the first pocket, while the pillow cushion is located inside of the pillow case.

2. The method of claim 1 further comprising taking the first substantial portion of the pillow case and the pillow cushion out of the first pocket, while the pillow cushion is located inside of the pillow case and inserting a second substantial portion of the pillow case and the pillow cushion into the second pocket, while the pillow cushion is located inside of the pillow case.

3. The method of claim 1 wherein the first pocket is substantially rectangular shaped;

and the second pocket is substantially rectangular shaped.

4. The method of claim 1 wherein the first pocket has an opening side, and the second pocket has an opening side;

and wherein the opening side of the first pocket is substantially perpendicular to the opening side of the second pocket.

5. The method of claim 1 wherein the pillow case can be folded up and inserted into the first pocket, when the pillow cushion is in the pillow case, such that the first substantial portion of the pillow cushion and the pillow case is located in the first pocket;

and wherein pillow case can be folded up and inserted into the second pocket, when the pillow cushion is in the pillow case, such that a second substantial portion of the pillow cushion and the pillow case is located in the second pocket.

6. The method of claim 1 wherein a first strap is attached to the pillow case;

and wherein the first strap can be used to carry the pillow case and can be used to retain the pillow case in a folded up state.

7. The method of claim 6 wherein a second strap is attached to the pillow case;

and wherein the second strap can be used to carry the pillow case and can be used to retain the pillow case in a folded up state.

8. The method of claim 1 wherein the top of the pillow case has an area, and the first pocket takes up less than half of the area of the top of the pillow case;

the bottom of the pillow case has an area, and the second pocket takes up less than half of the area of the bottom of the pillow case;

the first pocket has a length and a width, wherein the length of the first pocket runs along a width of the pillow case;

the second pocket has a length and a width, wherein the length of the second pocket runs along a length of the pillow case;

and wherein the first pocket and the second pocket overlap for an area equal to approximately the width of the first pocket times the width of the second pocket.

9. The method of claim 8 wherein the first pocket is elongated such that the length of the first pocket is substantially greater than the width of the first pocket; and the second pocket is elongated such that the length of the second pocket is substantially greater than the width of the second pocket.

10. A method comprising attaching a pocket to a top of a pillow case;

wherein the pillow case has a main inner chamber located within the pillow case, such that a pillow cushion can be located in the main inner chamber;

further comprising locating a pillow cushion in the main inner chamber;

and wherein the top of the pillow case has an area, and the pocket takes up less than half of the area of the top of the pillow case;

wherein the pillow case has a width and a length;

wherein the pocket runs substantially along the entire width of the pillow case;

and further comprising inserting a substantial portion of the pillow case and the pillow cushion into the pocket, while the pillow cushion is located in the main inner chamber.

* * * * *